US005677684A

United States Patent [19]

McArthur

[11] Patent Number: 5,677,684

[45] Date of Patent: Oct. 14, 1997

[54] EMERGENCY VEHICLE SOUND-ACTUATED TRAFFIC CONTROLLER

[76] Inventor: Evan B. McArthur, 4432 Maybank Ave., Lakewood, Calif. 90712

[21] Appl. No.: 702,960

[22] Filed: Aug. 26, 1996

[51] Int. Cl.[6] ..... G08G 1/07

[52] U.S. Cl. ..... 340/906; 340/902; 340/907; 340/943; 340/944; 367/199

[58] Field of Search ..... 340/906, 907, 340/902, 943, 944, 901, 904; 367/197, 198, 199

[56] References Cited

U.S. PATENT DOCUMENTS

| | | | |
|---|---|---|---|
| 3,881,169 | 4/1975 | Malach | 340/906 |
| 3,895,344 | 7/1975 | Gill, Jr. et al. | 340/943 |
| 3,992,656 | 11/1976 | Joy | 361/182 |
| 4,380,004 | 4/1983 | Coats et al. | 340/902 |
| 4,775,865 | 10/1988 | Smith et al. | 340/906 |
| 4,806,931 | 2/1989 | Nelson | 340/907 |
| 4,864,297 | 9/1989 | Shaw et al. | 340/902 |

*Primary Examiner*—Jeffery Hofsass
*Assistant Examiner*—Davetta Woods

[57] ABSTRACT

An emergency vehicle sound-actuated traffic controller including an intersection of at least two roads with a plurality of traffic lights for directing traffic therethrough. The traffic lights have a conventional control box for the controlling thereof. Further provided is a microphone adapted to receive audio signals and further adapted to convert the audio signals to electrical pulses. Finally, control circuitry is electrically connected to the microphone and includes a switching mechanism. The switching mechanism includes a pair of contacts coupled to the control box. In operation, the switching mechanism has a first orientation with the contacts thereof open thereby allowing normal operation of the control box and the traffic lights and a second orientation with the contacts abutting each other thereby instructing the control box to direct all of the traffic lights to turn constant red. The control circuitry is adapted to shift the contacts of the switching mechanism to the second orientation thereof upon the instantaneous receipt of a siren of an emergency vehicle via the microphone. For safety purposes, the control circuitry is further adapted to initiate a timing sequence upon the instantaneous receipt of the siren of the emergency vehicle and further maintain the contacts of the switching gear in the second orientation thereof until the cessation of said timing sequence.

1 Claim, 3 Drawing Sheets

EMERGENCY VEHICLE SOUND-ACTUATED TRAFFIC CONTROLLER

BACKGROUND OF THE INVENTION

1. Field of the Invention

The present invention relates to an emergency vehicle sound-actuated traffic controller and more particularly pertains to forcing every traffic light at an intersection to turn constant red for a predetermined amount of time upon the detection of a siren of an emergency vehicle.

2. Description of the Prior Art

The use of siren detectors is known in the prior art. More specifically, siren detectors heretofore devised and utilized for the purpose of detecting a siren and further prompting action upon such detection are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,014,052 to Obeck; U.S. Pat. No. 4,914,434 to Morgan et al.; U.S. Pat. No. 4,864,297 to Shaw et al.; U.S. Pat. No. 3,992,656 to Joy; U.S. Pat. No. 4,380,004 to Coats et al.; and U.S. Pat. No. 3,881,169 to Malach.

In this respect, the emergency vehicle sound-actuated traffic controller according to the present invention substantially departs from the conventional concepts and designs of the prior art, and in so doing provides an apparatus primarily developed for the purpose of forcing every traffic light at an intersection to turn red for a predetermined amount of time upon the detection of a siren of an emergency vehicle.

Therefore, it can be appreciated that there exists a continuing need for a new and improved emergency vehicle sound-actuated traffic controller which can be used for forcing every traffic light at an intersection to turn red for a predetermined amount of time upon the detection of a siren of an emergency vehicle. In this regard, the present invention substantially fulfills this need.

SUMMARY OF THE INVENTION

In view of the foregoing disadvantages inherent in the known types of siren detectors now present in the prior art, the present invention provides an improved emergency vehicle sound-actuated traffic controller. As such, the general purpose of the present invention, which will be described subsequently in greater detail, is to provide a new and improved emergency vehicle sound-actuated traffic controller which has all the advantages of the prior art and none of the disadvantages.

To attain this, the present invention essentially comprises an intersection of at least two roads. Such intersection has traffic lights for directing traffic in each direction of travel. For controlling the lights, the traffic lights have a conventional control box. As shown in FIGS. 2 & 3, a housing is provided having a front face, a rear face, and a periphery situated therebetween thus defining an interior space. For allowing access to the interior space by authorized personnel only, the front face is hingably coupled to the periphery and has a key actuated lock. Situated on the front face of the housing is a circular grate for allowing sound to travel therethrough. A circular back mounting plate is coupled via screws to the rear face within the interior space of the housing with a space situated therebetween. Further provided is a microphone situated on the back plate of the housing within the interior space thereof. See FIGS. 2 and 3.

The microphone is adapted to receive audio signals and further adapted to convert the audio signals to electrical pulses. Finally, control circuitry is encased within a box which is, in turn, coupled to the back plate of the housing within the interior space thereof. The control circuitry is electrically connected to the microphone. As best shown in FIG. 5, the control circuitry includes a switching gear with a first spring biased arm pivotally coupled at a first end thereof within the box with a contact situated on a second end thereof. A second spring biased arm is pivotally coupled at a first end thereof within the box with another contact situated on a second end thereof. Each contact is connected via wires to the control box of the traffic lights. In operation, the arms of the switch gear have a first unbiased orientation with the contacts thereof open, thereby allowing normal operation of the control box and the traffic lights. The arms further have a second biased orientation with the contacts abutting each other, thereby instructing the control box to direct all of the traffic lights to turn constant red. The control circuitry is adapted to shift the arms of the switching gear to the second orientation thereof upon the instantaneous receipt of a siren of an emergency vehicle via the microphone. To ensure that the lights remain constant red despite a momentary cessation of the siren by the operator thereof, the control circuitry is adapted to initiate a timing sequence upon the instantaneous receipt of the siren of the emergency vehicle during which the arms of the switching gear are maintained in the second orientation thereof until the cessation of such timing sequence.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved emergency vehicle sound-actuated traffic controller which has all the advantages of the prior art siren detectors and none of the disadvantages.

It is another object of the present invention to provide a new and improved emergency vehicle sound-actuated traffic controller which may be easily and efficiently manufactured and marketed.

It is a further object of the present invention to provide a new and improved emergency vehicle sound-actuated traffic controller which is of a durable and reliable construction.

An even further object of the present invention is to provide a new and improved emergency vehicle sound-actuated traffic controller which is susceptible of a low cost of manufacture with regard to both materials and labor, and which accordingly is then susceptible of low prices of sale to the consuming public, thereby making such emergency vehicle sound-actuated traffic controller economically available to the buying public.

Still yet another object of the present invention is to provide a new and improved emergency vehicle sound-actuated traffic controller which provides in the apparatuses and methods of the prior art some of the advantages thereof, while simultaneously overcoming some of the disadvantages normally associated therewith.

Yet another object of the present invention is to ensure safe passage of an emergency vehicle through an intersection despite the momentary deactivation of the siren thereof.

Still another object of the present invention is to force every traffic light at an intersection to turn red for a predetermined amount of time upon the detection of a siren of an emergency vehicle.

Lastly, it is an object of the present invention to provide a new and improved emergency vehicle sound-actuated traffic controller including an intersection of at least two roads with a plurality of traffic lights for directing traffic therethrough. The traffic lights have a conventional control box for the controlling thereof. Further provided is a microphone adapted to receive audio signals and further adapted to convert the audio signals to electrical pulses. Finally, control circuitry is electrically connected to the microphone and includes a switching mechanism. The switching mechanism includes a pair of contacts coupled to the control box. In operation, the switching mechanism has a first orientation with the contacts thereof open thereby allowing normal operation of the control box and the traffic lights and a second orientation with the contacts abutting each other thereby instructing the control box to direct all of the traffic lights to turn constant red. The control circuitry is adapted to shift the contacts of the switching mechanism to the second orientation thereof upon the instantaneous receipt of a siren of an emergency vehicle via the microphone. For safety purposes, the control circuitry is further adapted to initiate a timing sequence upon the instantaneous receipt of the siren of the emergency vehicle and further maintain the contacts of the switching gear in the second orientation thereof until the cessation of said timing sequence.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
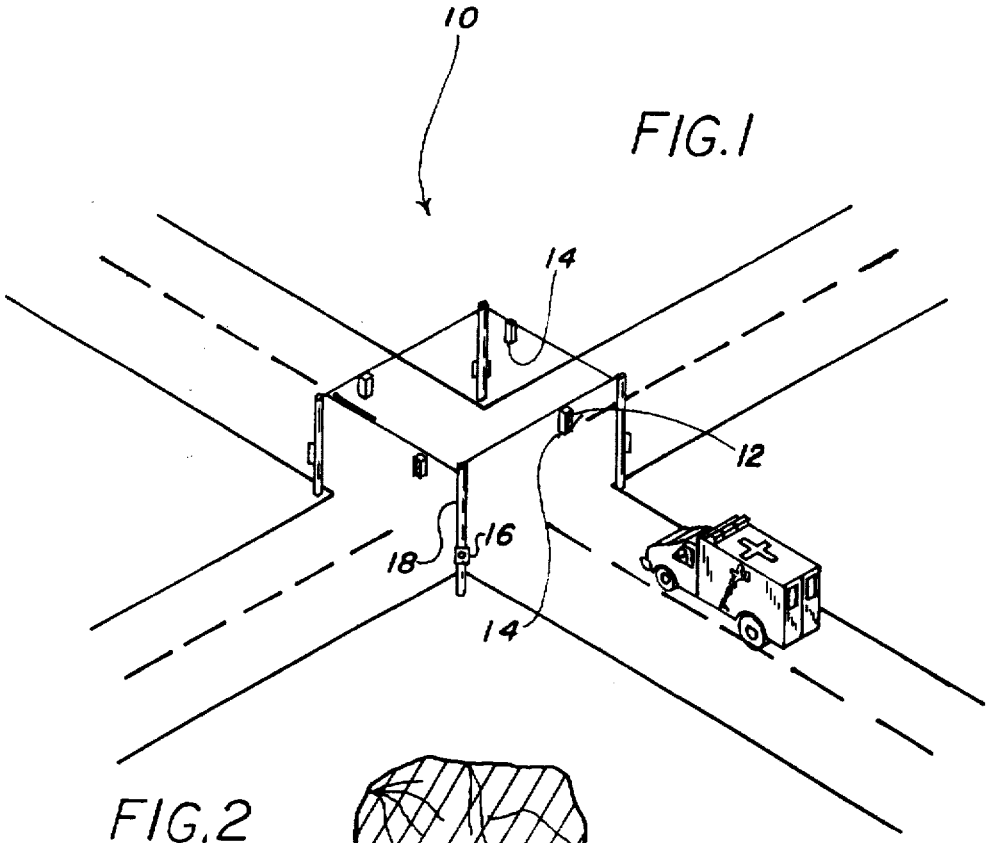
FIG. 1 is a perspective illustration of the preferred embodiment of the emergency vehicle sound-actuated traffic controller constructed in accordance with the principles of the present invention.

With reference now to the drawings, and in particular to FIG. 1 thereof, a new and improved emergency vehicle sound-actuated traffic controller embodying the principles and concepts of the present invention and generally designated by the reference numeral 10 will be described.

The present invention, the new and improved emergency vehicle sound-actuated traffic controller, is comprised of a plurality of components. Such components in their broadest context include a housing, microphone, and control circuitry. Such components are individually configured and correlated with respect to each other so as to attain the desired objective.

More specifically, it will be noted that the system 10 of the present invention includes an intersection of at least two roads. Such intersection has traffic lights 12 for directing traffic in each direction of travel. For controlling the lights, the traffic lights have a conventional control box 14.

Figure 2:
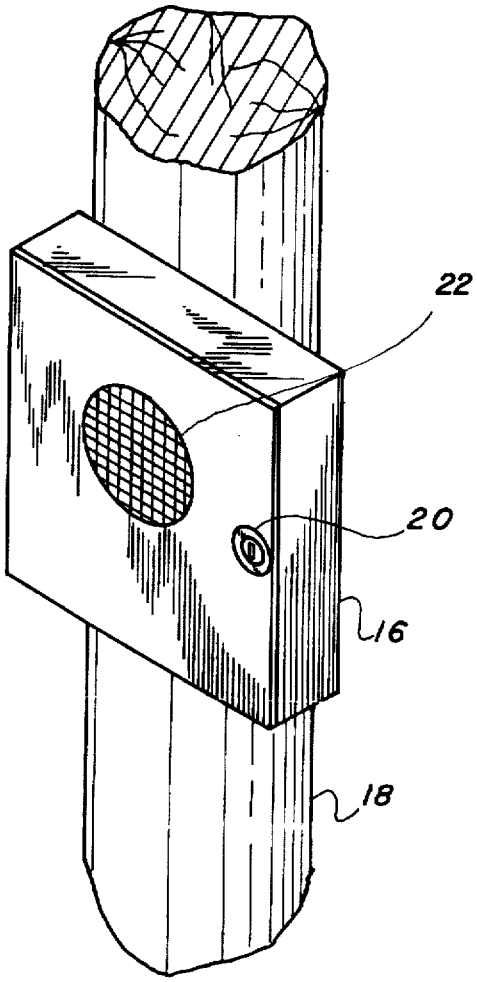
FIG. 2 is a close up view of the present invention.
Figure 3:
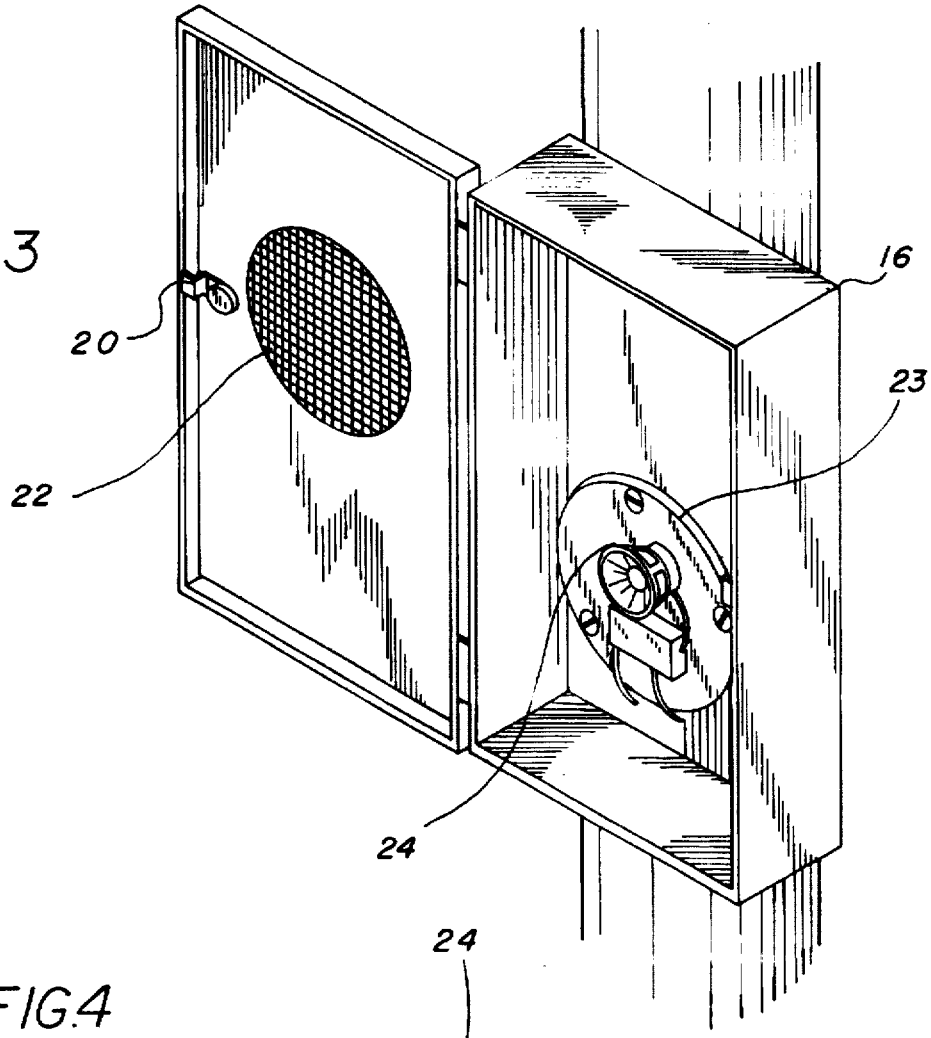
FIG. 3 is a close up view of the housing of the present invention with an open orientation.
Figure 4:
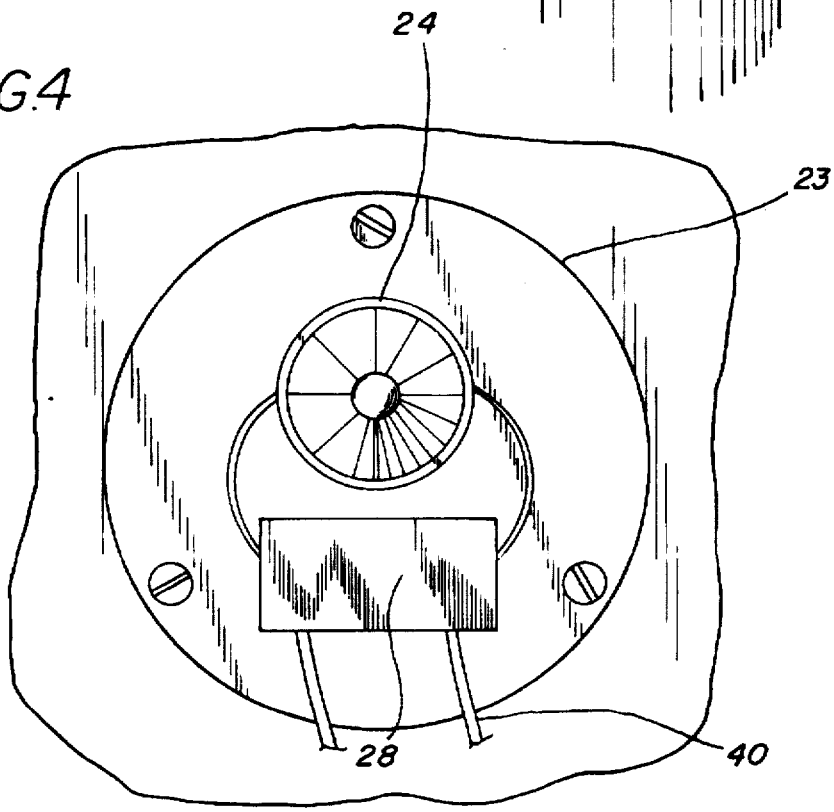
FIG. 4 is an illustration depicting the control circuitry of the present invention.

As shown in FIGS. 2 & 3, a housing 16 is provided having a front face, a rear face, and a periphery situated therebetween thus defining an interior space. Ideally, the housing is fixed to a post 18 to which the traffic lights are connected. For allowing access to the interior space by authorized personnel only, the front face is hingably coupled to the periphery and has a key actuated lock 20. Situated on the front face of the housing is a circular grate 22 for allowing sound to travel therethrough. A circular back mounting plate 23 is coupled via screws to the rear face within the interior space of the housing with a space situated therebetween. Preferably, the housing is constructed from a weatherproof metal or plastic.

Further provided is a microphone 24 situated on the back plate of the housing within the interior space thereof. See FIGS. 2 and 3. The microphone is adapted to receive audio signals and further adapted to convert the audio signals to electrical pulses.

Figure 5:
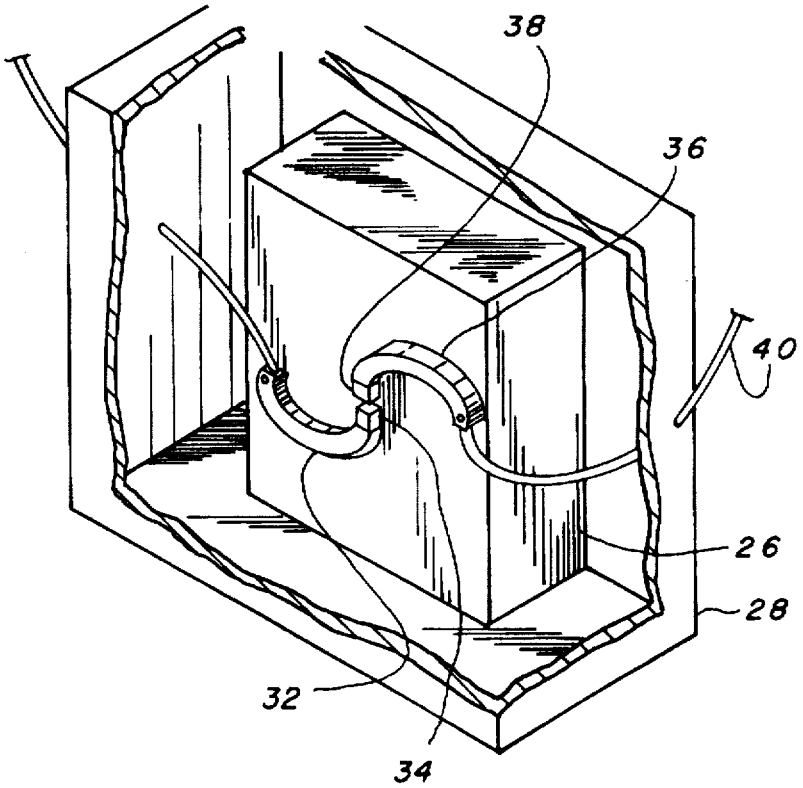
FIG. 5 is a cut-away view of the box in which the control circuitry is contained.

Finally, control circuitry 26 is encased within a box 28 which is, in turn, coupled to the back plate of the housing within the interior space thereof. The control circuitry is electrically connected to the microphone. As best shown in FIG. 5, the control circuitry includes a switching gear 30 with a first spring biased arm 32 pivotally coupled at a first end thereof within the box with a contact 34 situated on a second end thereof. A second spring biased arm 36 is pivotally coupled at a first end thereof within the box with another contact 38 situated on a second end thereof. Each contact is connected via wires 40 to the control box of the traffic lights. In operation, the arms of the switch gear have a first unbiased orientation with the contacts thereof open, thereby allowing normal operation of the control box and the traffic lights. The arms further have a second biased orientation with the contacts abutting each other, thereby instructing the control box to direct all of the traffic lights to turn constant red. Such is preferably accomplished by shorting switch within the control box which is used to manually employed in forcing the lights to turn constant red. The control circuitry is adapted to shift the arms of the switching gear to the second orientation thereof upon the instantaneous receipt of a siren of an emergency vehicle via the microphone. It should be noted that the exact circuitry employed for detecting the siren is conventionally known and commercially available. To ensure that the lights remain constant red despite a momentary cessation of the siren by the operator thereof, the control circuitry is adapted to initiate a timing sequence upon the instantaneous receipt of the siren of the emergency vehicle during which the arms of the switching gear are maintained in the second orientation thereof until the cessation of such timing sequence.

Figure 6:
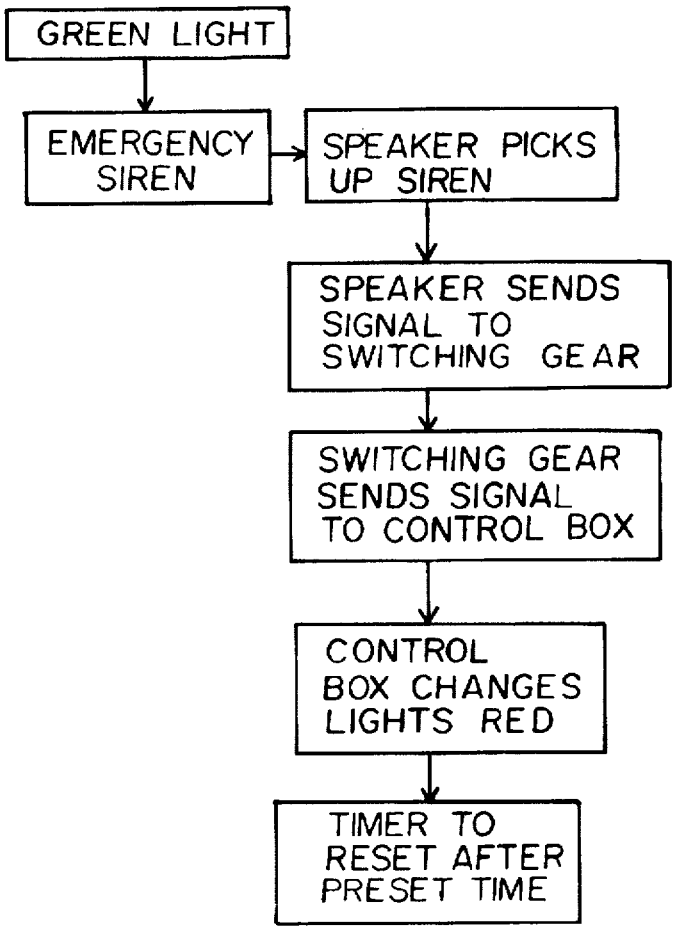
FIG. 6 is a flow chart showing the operation of the present invention.

In use, the present invention has associated therewith a specific method of operation as set forth in FIG. 6. Upon the detection of a siren, the speaker signals the control circuitry which, in turn biases the arms of the switching gear thereof. Biasing of the switching gear effects the closing of the contacts thereof thereby signalling the traffic lights to turn constant red. It is important to note that, at the time of detection of the siren, a timing sequence is initiated that expires after a predetermined amount of time of preferably in the order of 30–45 seconds. Only upon the expiration of the timing sequence will normal operation of the traffic lights resume.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved emergency vehicle sound-actuated traffic controller comprising, in combination:

an intersection of at least two roads with a plurality of traffic lights for directing traffic therethrough, the traffic lights having a conventional control box for controlling said lights;

a water-proof housing having a front face, a rear face, and a periphery situated therebetween thus defining an interior space, the housing mounted to a pole to which the traffic lights are mounted, the front face hingably coupled to the periphery and having a key actuated lock for allowing access to the interior space by authorized personnel, the housing further having a circular grate situated on the front face thereof and a circular back plate coupled via screws to the rear face within the interior space of the housing with a space situated therebetween;

a microphone situated on the back plate of the housing within the interior space thereof, the microphone adapted to receive audio signals and further adapted to convert the audio signals to electrical pulses; and control circuitry encased within a box coupled to the back plate of the housing within the interior space thereof, the control circuitry electrically connected to the microphone and including a switching gear having a first spring biased arm pivotally coupled at a first end thereof within the box with a contact situated on a second end thereof and a second spring biased arm pivotally coupled at a first end thereof within the box with a contact situated on a second end thereof, wherein each contact is connected via wires to the control box of the traffic lights, the arms of the switch gear having a first unbiased orientation with the contacts thereof open thereby allowing normal operation of the control box and the traffic lights and a second biased orientation with the contacts abutting each other thereby instructing the control box to direct all of the traffic lights to turn constant red by shorting a switch in the control box of the traffic lights that may be manually switched to effect the same, the control circuitry adapted to shift the arms of the switching gear to the second orientation thereof upon the instantaneous receipt of a siren of an emergency vehicle via the microphone, the control circuitry further adapted to initiate a timing sequence of approximately 30–45 seconds upon the instantaneous receipt of the siren of the emergency vehicle and further maintain the arms of the switching gear in the second orientation thereof until the cessation of said timing sequence.

* * * * *